US008464453B1

(12) United States Patent
Ubl et al.

(10) Patent No.: US 8,464,453 B1
(45) Date of Patent: Jun. 18, 2013

(54) BLOWBACK BOLT UPPER RECEIVER AND BARREL ASSEMBLY

(75) Inventors: Timothy Ubl, Hutchinson, MN (US); Jarmo Kumpula, Minnetrista, MN (US)

(73) Assignee: Nordic Components, Inc., Hutchinson, MN (US)

( * ) Notice: Subject to any disclaimer, the term of this patent is extended or adjusted under 35 U.S.C. 154(b) by 155 days.

(21) Appl. No.: 13/008,446

(22) Filed: Jan. 18, 2011

Related U.S. Application Data

(60) Provisional application No. 61/295,935, filed on Jan. 18, 2010.

(51) Int. Cl.
*F41A 3/00* (2006.01)

(52) U.S. Cl.
USPC ..... 42/16; 42/15

(58) Field of Classification Search
USPC ..... 42/16–25
See application file for complete search history.

(56) References Cited

U.S. PATENT DOCUMENTS

| | | | | | |
|---|---|---|---|---|---|
| 1,396,949 | A | * | 11/1921 | Eickhoff | 89/154 |
| 1,827,037 | A | * | 10/1931 | Pedersen | 89/154 |
| 2,624,241 | A | * | 1/1953 | Hill | 89/33.17 |
| 2,667,817 | A | * | 2/1954 | Asby, Jr. | 89/172 |
| 2,816,484 | A | * | 12/1957 | Grages | 89/194 |
| 3,850,076 | A | * | 11/1974 | Atchisson | 89/196 |
| 4,066,000 | A | * | 1/1978 | Rostocil | 89/198 |
| 4,069,607 | A | | 1/1978 | Jurek | |
| 4,169,329 | A | * | 10/1979 | Atchisson | 42/16 |
| 4,231,177 | A | * | 11/1980 | Foote | 42/16 |
| 6,625,916 | B1 | | 9/2003 | Dionne | |
| 2010/0162604 | A1 | * | 7/2010 | Dubois | 42/18 |
| 2012/0159828 | A1 | * | 6/2012 | Jarboe et al. | 42/16 |

* cited by examiner

*Primary Examiner* — Samir Abdosh
(74) *Attorney, Agent, or Firm* — Dwayne E. Rogge; Schacht Law Office, Inc.

(57) ABSTRACT

Disclosed herein is a modified upper receiver assembly, which in one form is operatively configured to be fitted to a conventional lower receiver of a rifle so the user can use their normal lower receiver having a pistol grip, trigger assembly and butt stock. The upper receiver is configured to provide a blowback bolt assembly of larger mass than would be possible with similar density materials of a bolt fitted within an upper receiver conventionally made for said lower receiver.

12 Claims, 15 Drawing Sheets

BLOWBACK BOLT UPPER RECEIVER AND BARREL ASSEMBLY

RELATED APPLICATIONS

This application claims priority benefit of U.S. Ser. No. 61/295,935, filed Jan. 18, 2010 and incorporated herein by reference.

SUMMARY OF THE DISCLOSURE

Disclosed herein is an upper receiver assembly having an upper receiver with an interior surface defining an interior chamber. The upper receiver has a longitudinal forward region having a barrel mounting portion and a longitudinal rearward region comprising a surface defining a spring guide passage. There is also an upper region having a surface defining a charge handle passage.

There is a bolt comprising a surface defining a firing pin passageway. A firing pin is movably positioned to move a prescribed amount of distance within the firing pin passageway. The bolt has a longitudinally forward region with a bolt surface. The bolt also has an upper region having a charge handle engagement surface. Also there is a surface defining a recoil guide rod chamber on the bolt.

A charge handle is positioned within the charge handle passage of the upper receiver. The charge handle having a bolt engagement feature positioned to engage the charge handle engagement surface of the bolt so the charge handle is configured to reposition the bolt in a longitudinal rearward direction with respect to the upper receiver and further the bolt can reposition longitudinally rearwardly and forwardly without movement of the charge handle when the charge handle is in a longitudinally forward orientation with respect to the upper receiver.

A recoil spring guide operatively configured to be assembled to the upper receiver by way of passing through the spring guide passage of the upper receiver is located in a longitudinal rearward portion of the upper receiver where the recoil spring guide rod passes through the surface defining a recoil guide rod chamber within the bolt. A backer plate house is located within the interior chamber of the upper receiver. Other features and arrangements are provided herein.

Rifle craft is premised upon training with a rifle of choice by the shooter. A common platform for a high-power rifle is the AR-15 and its various derivatives. In general, an AR-15 has an upper and lower receiver where the lower receiver comprises the trigger assembly, pistol grip and butt stock. Further, the lower receiver is considered by ATF standards the main portion of the firearm, which is subject to regulation for delivery, transport and a host of other regulatory restrictions. The upper receiver of a platform such as the AR-15 generally has the barrel attached thereto and some sort of an action, which is normally a bolt-and-carriage assembly with the characteristic turning locking bolt which provides accuracy for the centerfire .223 Remington round. Of course, in the broader scope, other platforms can be utilized with the disclosure described herein, but in particular with the AR-15 it is common to have a specific lower receiver that the shooter is comfortable with when performing with the rifle and simply training.

Recently, the cost for ammunition has risen considerably. At the time of this filing it is fairly cost prohibitive to expend a high number of .223 rounds, as the cost of each round is doubled and almost tripled in some instances in view of cost the same rounds just a few years ago. Preferred alternatives include .22 long rifle rimfire rounds, .22 Winchester Magnum Rimfire, and similar cartridges which can be shot at a fraction of the cost of a centerfire high caliber round such as the .223 Remington (or alternatively the 5.56 NATO round) and other relatively large calibers.

Of course, there are various other alternatives in the marketplace, such as converting an action, such as a Ruger 10-22 action, which is specifically made for the .22 long rifle round, and having fixtures to this action, which gives the same look and feel as an AR-15. However, the underlying action itself is that of a Ruger 10-22 and is limited to the Ruger 10-22 trigger.

Disclosed herein is an upper receiver conversion where the shooter can utilize the lower assembly of their existing AR-15, M-4, AR-10 or other variants, and, in the broader scope, other rifle platforms altogether, in particular rifles with a lower receiver having a trigger group housed therein, and utilize these existing elements of their rifle with a dedicated upper assembly and barrel specifically designed for reliability and high performance with the rimfire .22 long rifle round (or, in the broader scope, other rounds could be employed).

It is further well known that .22 long rifle rounds carry a relatively small charge of powder. Therefore, in one form, providing an upper receiver having an enlarged interior passageway with a bolt having more mass relative to conventional interior passageways and bolts, fitted therein is desirable because the blowback feature of the action will have energy being absorbed to accelerate the heavier mass of the bolt, as opposed to pressing against a spring. Although disclosed herein is an assembly with a spring positioned in an operative matter on the bolt, in one form a spring with a lower spring constant and less pre-tension placed thereon can be employed, which can enhance reliability. Further, in general the bolt operates to reset the trigger of the lower receiver. Because the upper receiver assembly is configured to work with a plurality of types of lower receivers including competition triggers, duty triggers and plain stock triggers, which may have higher powered springs acting on the hammer of the trigger assembly, there are numerous unknowns where the upper receiver must be robust enough to have sufficient force placed upon the hammer so as to re-cock the hammer when in operation. By having a dimension provided with a heavier bolt, the momentum energy is conserved and transferred to accelerating the bolt as opposed to compressing a spring, whereas other prior art devices such as the Ciener Kit have limited ability to add mass to the operating bolt by way of operating within the existing upper receiver of the shooter's firearm. It should be noted that because the upper receivers are preconfigured to be retrofitted to the lower receiver, there are various dimensional constraints placed on the upper receiver. For example, the positions of the magazine and the bullets contained in the magazine are fixed based upon the orientation of the magazine (mag) well of the lower receiver, which is standard in, for example, the AR-15. Further, the location of the trigger assembly in the lower receiver is at a specified location, and the hammer is designed to strike a firing pin on the bolt of the upper receiver at a specified (central) location. Therefore, between the mag well and the hammer there is a limited amount of longitudinal space to fit a bolt. One option would be to have a heavier bolt made of, for example, a denser material such as tungsten carbide, and fit such a bolt within an existing upper receiver of an AR-15. However, this option creates a more expensive product to manufacture. Therefore, as disclosed herein, the interior chamber of the upper receiver has a slightly larger cross-section than, for example, conventional AR-15 specification, so as to provide a heavier bolt to be fitted therein. Further, the upper receiver sold with the bolt can be arranged in a manner so there is a sufficiently tight tolerance that the upper receiver guides the bolt and ensures a true engagement to the barrel to enhance the accuracy, even with a blowback action design.

In summary, disclosed herein is a novel and non-obvious arrangement of components in light of the prior art to utilize existing rifle components, including the trigger assembly, pistol grip and butt stock of a lower receiver, with a dedicated upper receiver while shooting a much less expensive round. It should be further noted that other custom elements of the lower receiver are common, such as an increased-size mag well and, in some cases, a customized mag release button. In one form, the upper receiver can be arranged to operate with a black dog magazine, which has a cross-sectional area of sufficient size to fit within the mag well of a conventional AR-15 receiver. Further, the black dog magazines have a desirable round capacity and are presently being operated with devices to quickly load the magazines to allow the shooter to train more and spend less time loading.

DESCRIPTION OF THE PREFERRED EMBODIMENTS

Figure 1A:
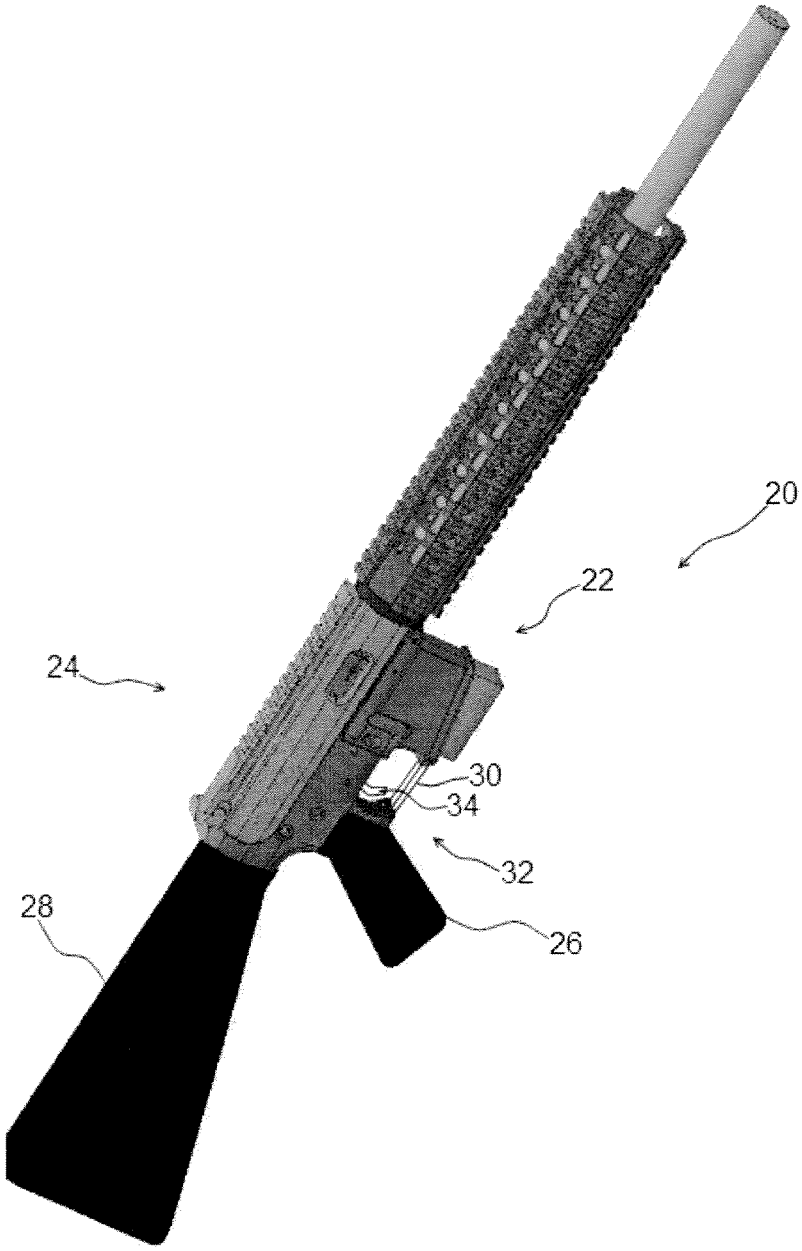
FIG. 1A shows a view of the complete rifle assembly.

Shown in FIG. 1A is a complete rifle assembly 20. In general, the rifle assembly 20 comprises a lower assembly 22 and an upper assembly 24. The lower assembly 22 can have a pistol grip 26 and butt stock 28 attached thereto. Further, as shown above, the trigger guard 30 contained within the lower assembly 22 is a trigger assembly 32 which forms in part the actual trigger 34 which is visible in FIG. 1A. In general, a trigger assembly comprises a disconnector, a hammer and a trigger member which operate in a method with an action so some form of an action impinges a force upon the hammer (not shown) so as to cock the hammer rearwardly. The disconnector operates such that if the shooter followed through on the shot and still has the trigger fully depressed, the disconnector will engage the hammer, and as the shooter releases the trigger forward, the hammer will catch against the trigger member and be ready to fire a second shot in semi-automatic mode. Of course, in other forms such as three-round bursts and full automatic such as the M-16, the trigger assembly is arranged in a different manner to allow for this rapid-fire capability.

A common example of a trigger assembly, such as a drop-in trigger, is ascribed in the patent assigned to JP Enterprises having U.S. Pat. No. 7,421,937 incorporated herein by reference.

Figure 1B:
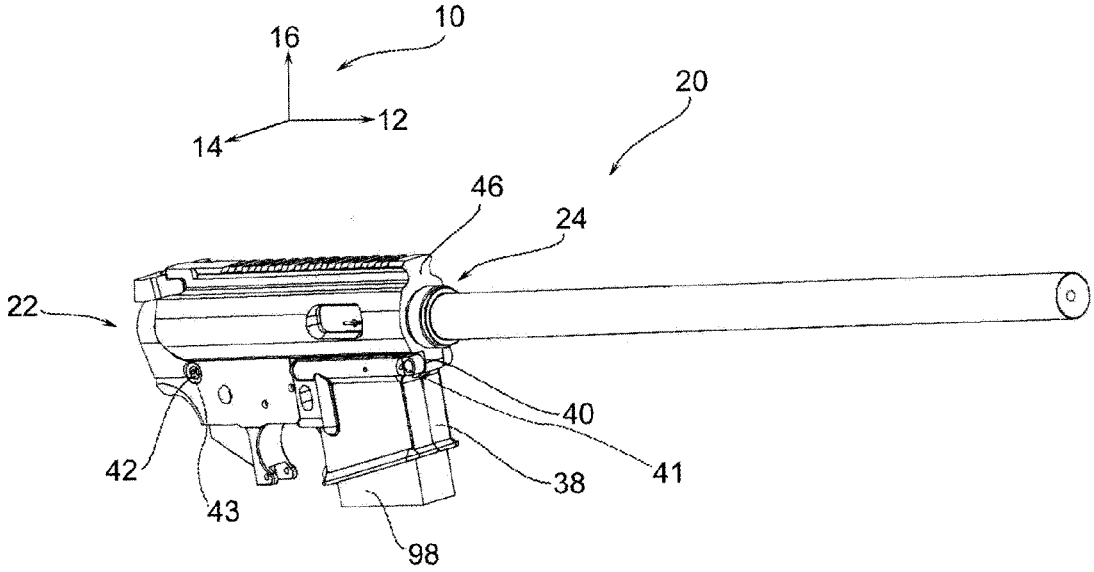
FIG. 1B shows an upper assembly attached to a lower receiver which is stripped down.

As shown in FIG. 1B, to aid in the description an axes system 10 is defined where the axes 12 indicates a longitudinal axis pointing in the forward direction, the axis 14 is a lateral axis, and 16 is a vertical axis. In general, the axis 14 points in a first lateral direction where an opposing direction would be a second lateral direction. Of course the axes are for general reference purposes to the common orientation of the rifle 20, and it is understood that the rifle could be orientated in other directions without at all limiting the scope of the disclosure.

As shown in FIG. 1B, there is a lower assembly 22 that has been partially stripped down and where the trigger assembly, pistol grip and butt stock are removed therefrom. In a portion of the lower assembly is the lower receiver 38. In general, the lower receiver has a first connection location 40, which is generally a pin connection 41, and further a second connection location 42. In general, it is common to remove the pin 43 a partial distance at the second connection location 42, which disengages the rearward portion of the upper assembly 24, thereby allowing pivotal attachment at the first connection location 40.

Figure 2:
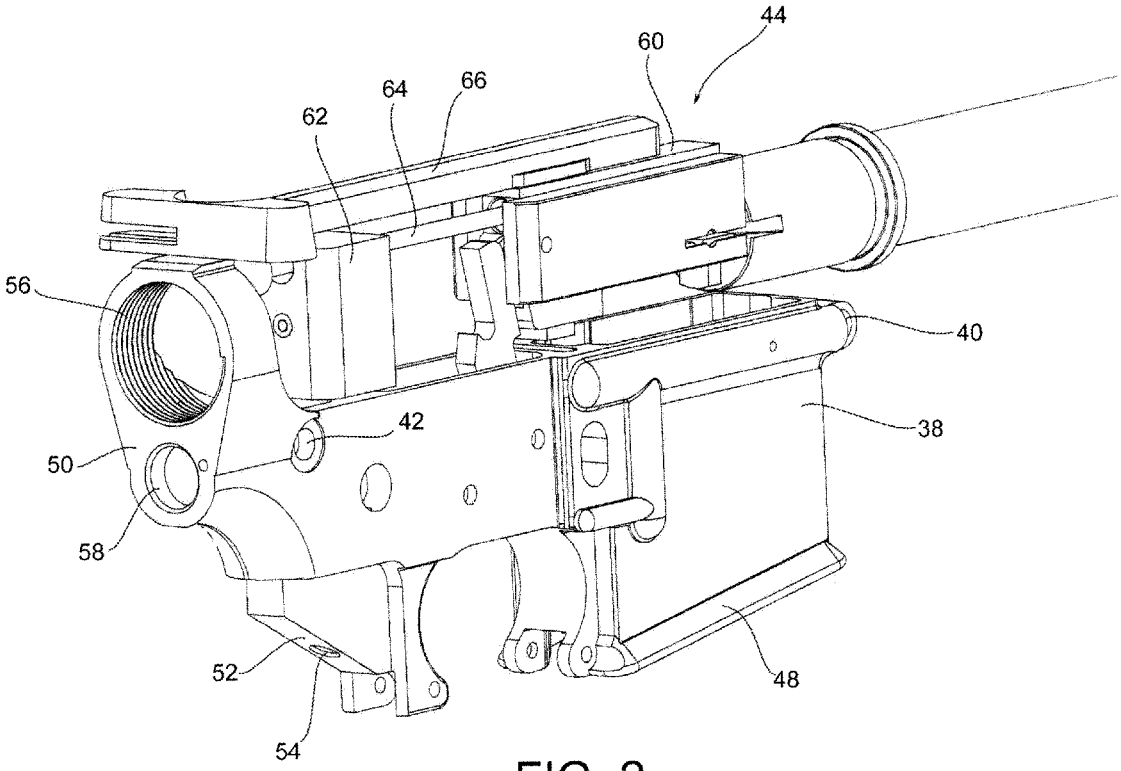
FIG. 2 shows an isometric view of a lower receiver with the bolt assembly components positioned thereabove, where this unique view does not show an upper receiver which would house the bolt assembly components.
Figure 4:
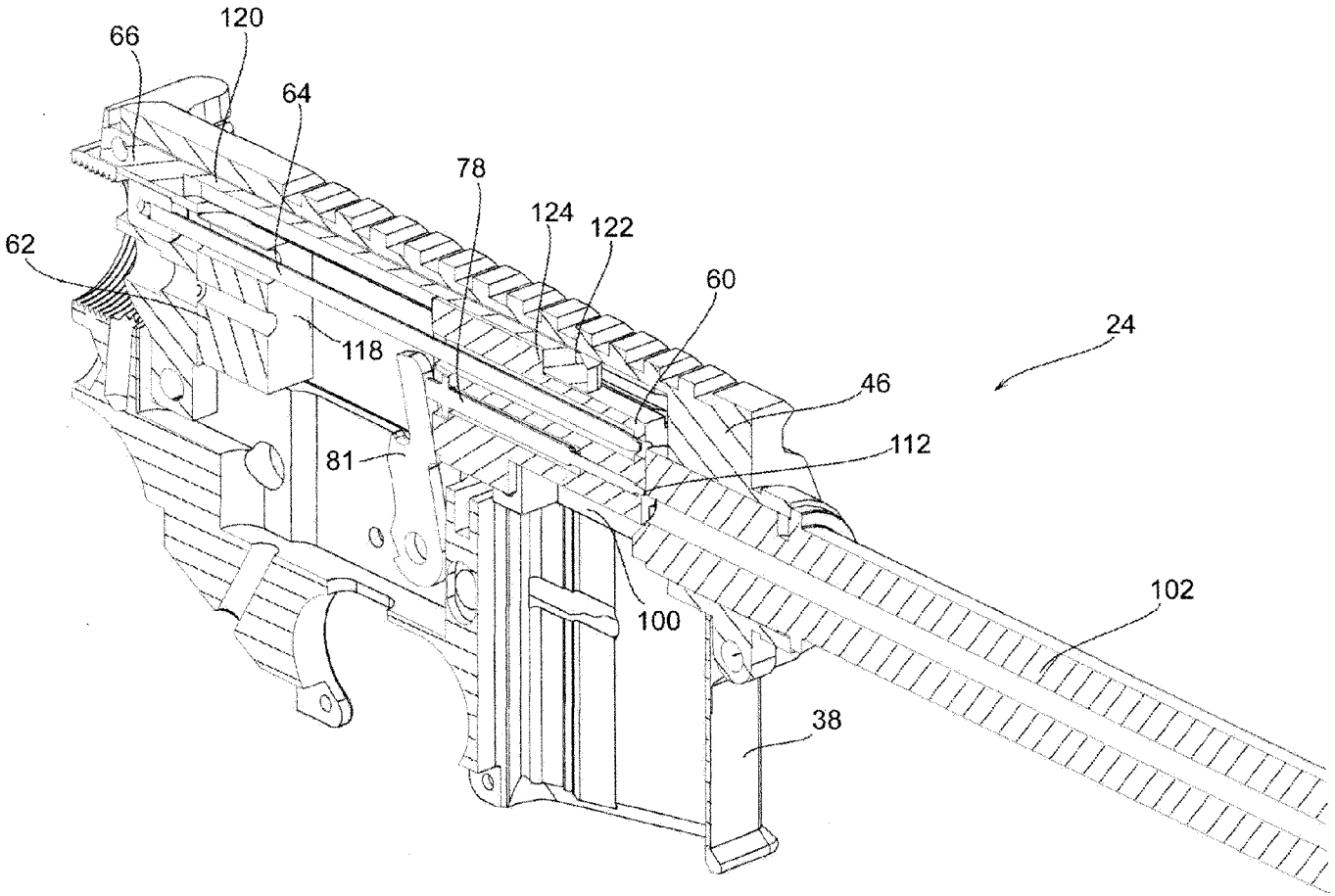
FIG. 4 shows an orthogonal view in cross-section of the upper and lower receivers.

As shown in FIG. 2, there is a rather unique view of one embodiment of the bolt assembly components 44 that are generally housed within the upper receiver 46, as shown in FIG. 1B. To aid the description of the both assembly components, FIG. 2 shows the various orientations of the herein described components, and it is to be understood that in normal operation, the upper receiver 46 as shown in FIG. 4 is utilized to house and properly orientate and position the components 44.

FIG. 2 shows the lower receiver 38 where, in general, the lower receiver further comprises a magazine (mag) well 48 and a butt stuck attachment location 50. Further, there is a pistol grip attachment location 52 comprising a void 54, which is generally threaded and configured to fit a screw through the pistol grip to mount the pistol grip thereto. The threaded portion 56 of the butt stock attachment location 50 is generally provided to have a tubular member housing a mainspring therein, which is a characteristic portion of an AR-15. The lower surface 58 is generally provided to properly orientate and position the butt stuck.

Still referring to FIG. 2, the bolt assembly components 44 generally comprise a bolt 60, a back plate 62, a recoil spring guide 64, and a charge handle 66. Of course, in the broader scope, some of these components could be combined or integrate with one another, but in general the components of the bolt, backplate, recoil spring guide and charge handle operate within the upper receiver 46 (see FIG. 4) to provide a functioning upper receiver that is very robust by being able to operate with a plurality of lower receivers, along with a host of different types of .22 long rifle ammunition (in one form).

Figure 3:
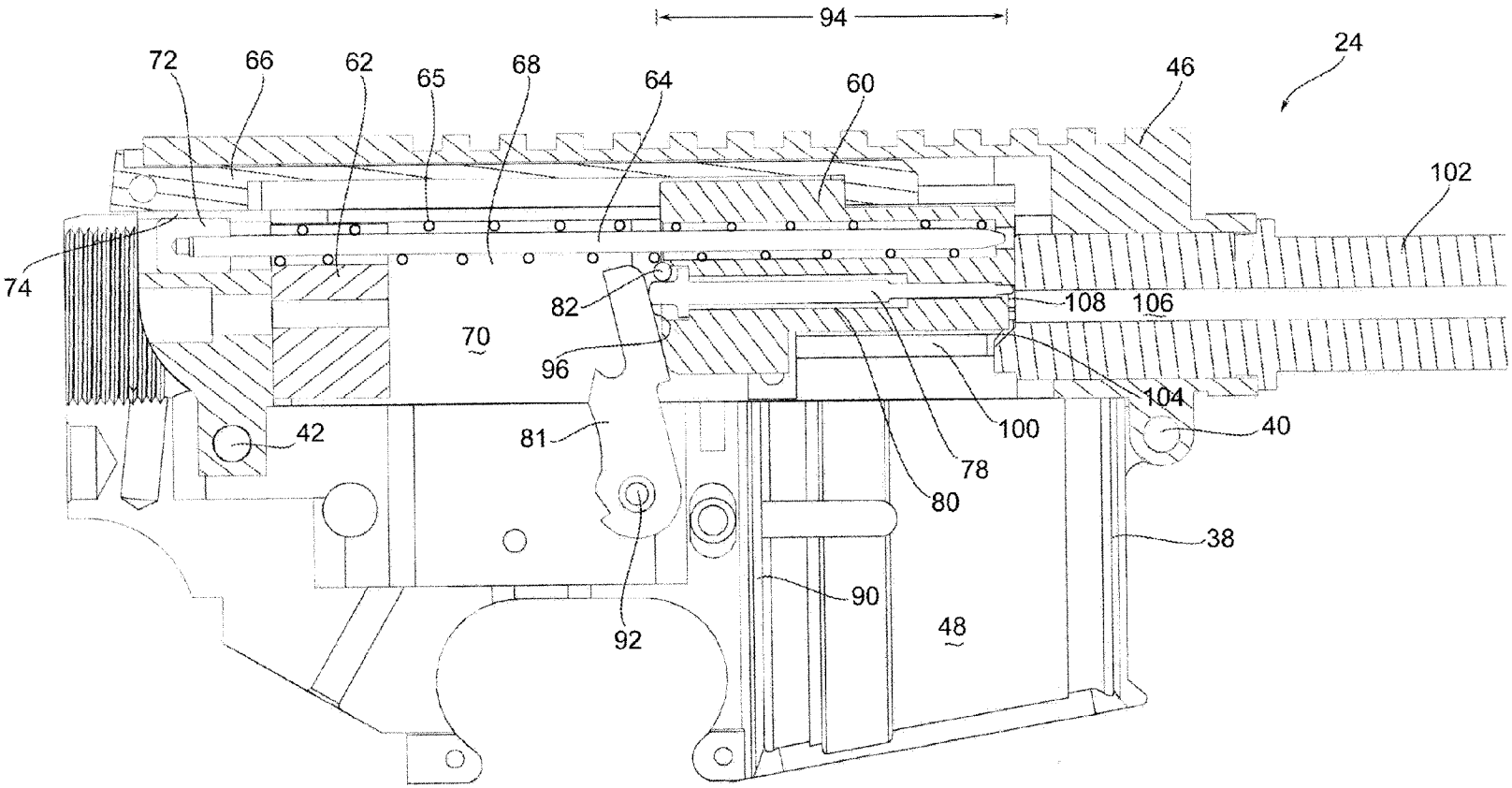
FIG. 3 is a side cross-sectional view of the upper and lower receivers.
Figure 5:
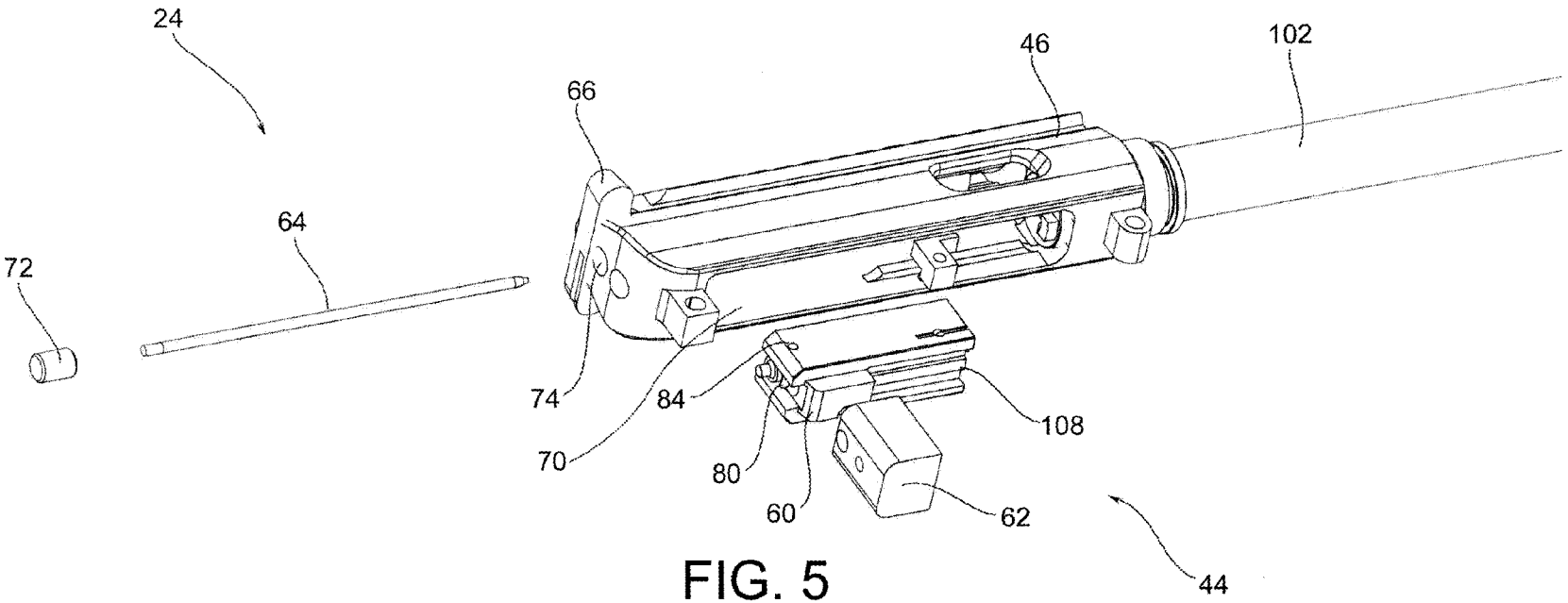
FIG. 5 shows an exploded view of the bolt assembly components positioned around the upper receiver.
Figure 6:
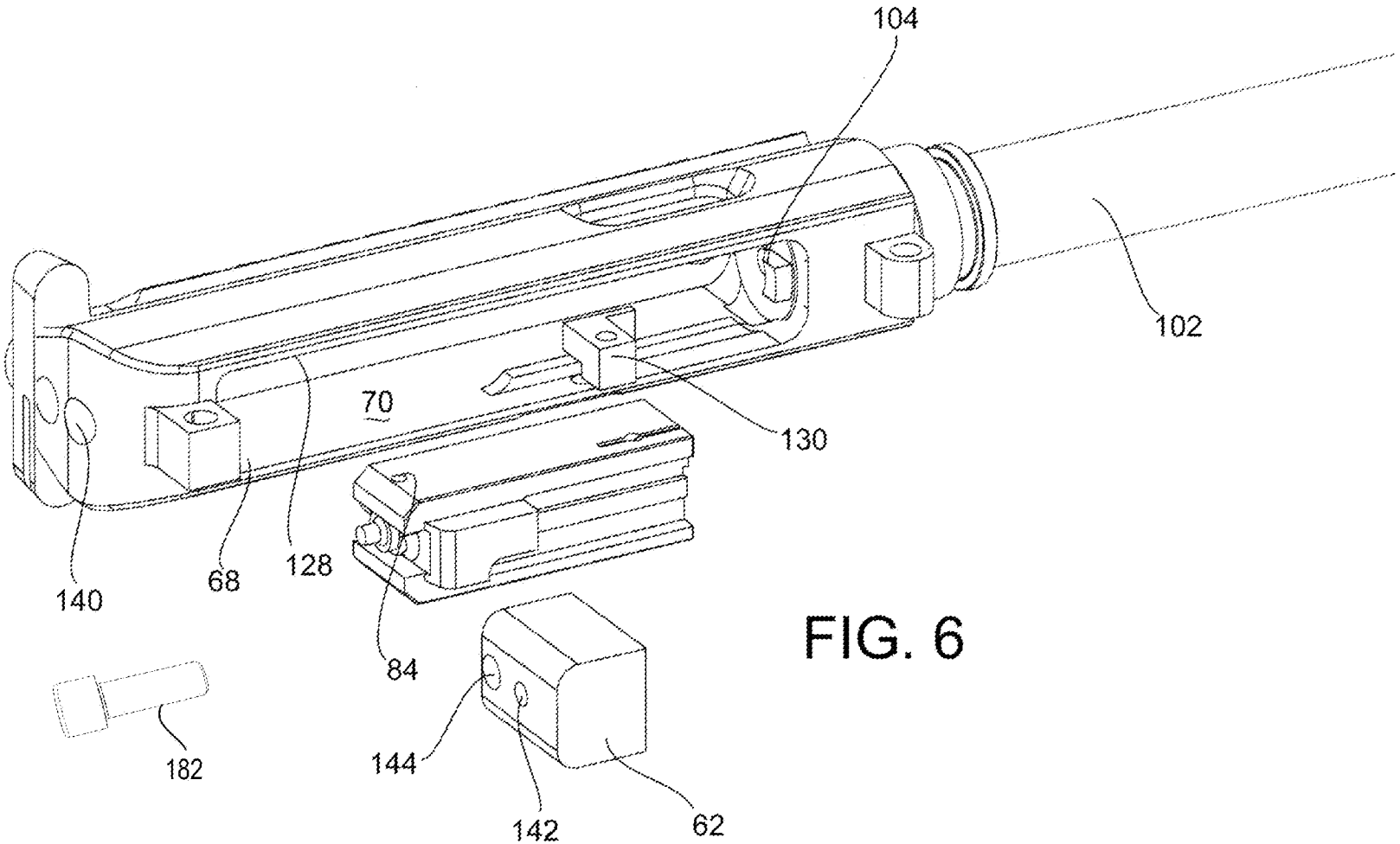
FIG. 6 shows the bolt and backer plate position below the interior chamber of the upper receiver.

As shown in FIG. 3, there is a cross-sectional view of the upper assembly 24 attached to the lower receiver 38. In general, the upper receiver 46 has an interior surface 68 defining an interior chamber 70. The bolt 60 is arranged to move longitudinally within the interior chamber 70 and in part be guided by the interior surface 68 and further by the recoil spring guide 64. Positioned in a longitudinally rearward portion of the upper receiver is a backplate 62, which can absorb the impact from the bolt 60, and a retaining plug 72 that can be configured to threadedly engage the surface defining the spring guide passage 74 (see also FIG. 5) so as to retain the recoil spring guide 64 and recoil spring 65 therein. Housed within the bolt 60 is the firing pin 78, which is configured to move a prescribed amount within a firing pin passage 80. In one form, the firing pin is retained in the bolt by the crosspin 82, which is configured to fit within the firing pin retaining surface 84, as shown in FIGS. 5 6. It should be noted that the orientation of the mag well 48 with respect to the hammer 81, as shown in FIG. 3, is generally a defined distance with respect to one another, where, for example, the longitudinally rearward surface 90 of the mag well is at a defined distance to the pivot point 92 of the hammer 81. Therefore, it can be appreciated that the lower receiver 38 has the prescribed dimensions of the mag well and the hammer to allow for only so much distance generally defined by the dimension 94 for positioning the bolt. In other words, the hammer face 96, which is adapted to strike the firing pin 78, must strike the firing pin at a prescribed point for direct hits thereupon to insure proper firing of the round, which in one form is a rimfire round. Further, the magazine 98, as shown in FIG. 1B, which in one form could be a black dog magazine housing 22 rimfire cartridges, positions the bullets at a prescribed location, such as the feed region 100 as shown in FIG. 3. In general, the barrel 102 has a feed ramp 104 allowing the bullets to slide upward and into the chamber 106. This feeding action occurs with the bolt surface 108 as the bolt slides longitudinally forward after being positioned in the longitudinally rearward portion of the internal chamber 70. Therefore, it can be appreciated that the bolt 60 can only have a dimension in the longitudinal direction of a certain length to operate with the specifications of a lower receiver 38, in particular an AR-15 lower receiver (in its various derivatives, and of course in the broader scope other lower receiver platforms). As shown in FIG. 4, there is an isometric cross-sectional view taken in the vertical plane orthogonal to the lateral axis 14. This vertical plane is through a laterally central location of the upper receiver assembly 24 and the lower receiver 38. This isometric view generally shows the feed region 100 and it can be appreciated that when a round is fired by way of the firing pin 78 impacting the upper rim region indicated at the striker region 112, the equal and opposite force of the accelerating bullet traveling down the barrel 102 impinges a blowback force upon the bolt 60. A spring (not shown but housed around the recoil spring guide 64) in part absorbs energy of the rearwardly accelerating bolt 60. Further, the hammer 81 generally has a main hammer spring (not shown) attached thereto, such as a torsional spring, whereas cocking the hammer rearwardly to the various seer surfaces retains the hammer in a retained position are executed by way of the rearward travel of the bolt and further absorbing some of the kinetic energy therefrom. Finally, the backer plates 62 will in general be designed to impact the rearward portion of the bolt at the longitudinal front surface 118. As shown in, for example, FIG. 5, the bolt 60 can have a larger design, and in one form a more rectangular design corresponding to the general fit of the interior chamber 70, so as to have a larger cross-sectional dimension than the anterior chamber of a conventional upper receiver of an AR-15.

As shown in FIG. 5, there is an upper receiver 46 attached to the barrel 102 and an oblique isometric view showing the opening to the interior chamber 70. In general, the bolt assembly components 44 are shown in the disassembled exploded view, and there will now be a general discussion of one form of assembling the upper assembly 24.

It should first be noted that the charge handle 66, which is configured to be mounted within a surface defining a charge handle passage 120 as shown in FIG. 4, is shown in FIG. 5 in an engaged position within the upper receiver 46. Referring back to FIG. 4, the charge channel has a bolt engagement feature 122 configured to engage the charge handle engagement surface 124 of the bolt 60. The charge handle is generally operated to reposition the bolt rearwardly to chamber around from a magazine such that when the bolt is in operation, the charge handle does not reposition longitudinally with the bolt during operation of the bolt when firing a round.

Figure 11:
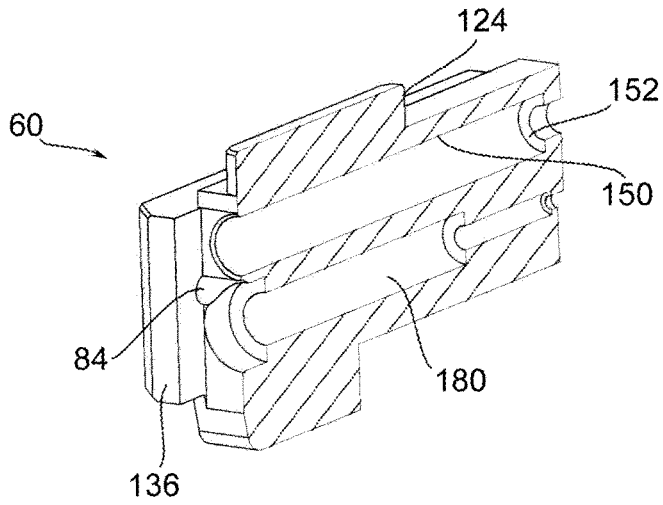
FIG. 11 is a cross-sectional view of the bolt.

Now referring ahead to FIG. 11, it can be seen that the bolt 60 is shown in a cross-sectional view. In general, the bolt 60 has a surface defining a recoil guard rod chamber 150, which is also referred to herein as a recoil spring chamber. The angular surface 152 is generally referred to as a recoil guide rod receiving location, which, in one form, can have a portion of a recoil spring, such as a helical spring, imparting the force thereto. The surface defining the firing pin passage 180 can be shown where the laterally extending open way defining the firing pin retaining surface 84 is shown where a pin is configured to fit therethrough and keep the firing pin retained therein for a prescribed amount of longitudinal travel with the bolt. Further, the longitudinal rearward surface 136 of the bolt is configured to engage and strike the longitudinal forward surface 118 of the backer plate (see FIG. 8). Positioned in the upward region is a small extension, which is generally referred to as a charge handle engagement surface 124, where the charge handle 66 (see FIGS. 2-4) can engage the bolt to reposition it longitudinally rearwardly, which is generally used to chamber around or otherwise hold the bolt in the rearward location to show a safe condition.

Figure 7:
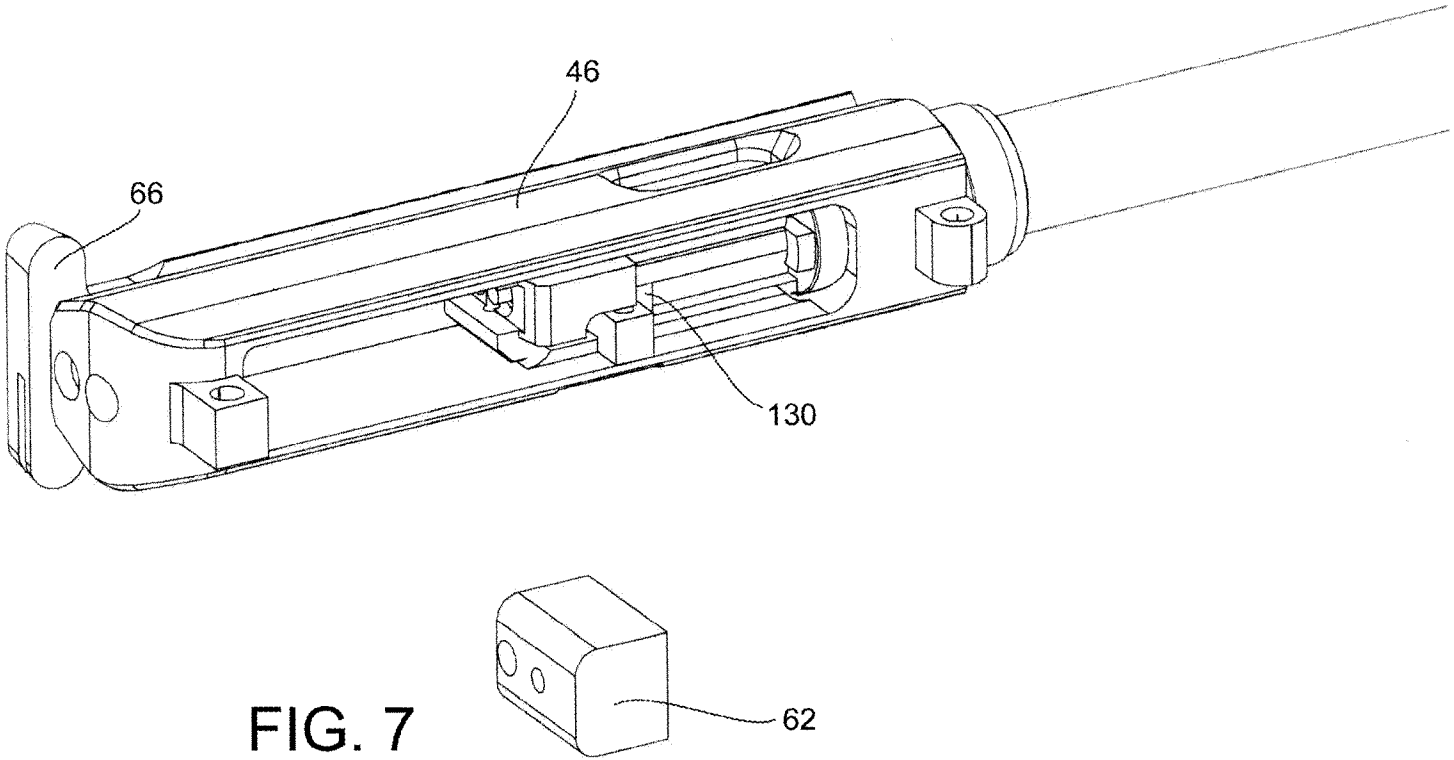
FIG. 7 shows the bolt positioned upwardly and forwardly within the interior chamber of the upper receiver where the backer plate is still positioned therebelow.
Figure 8:
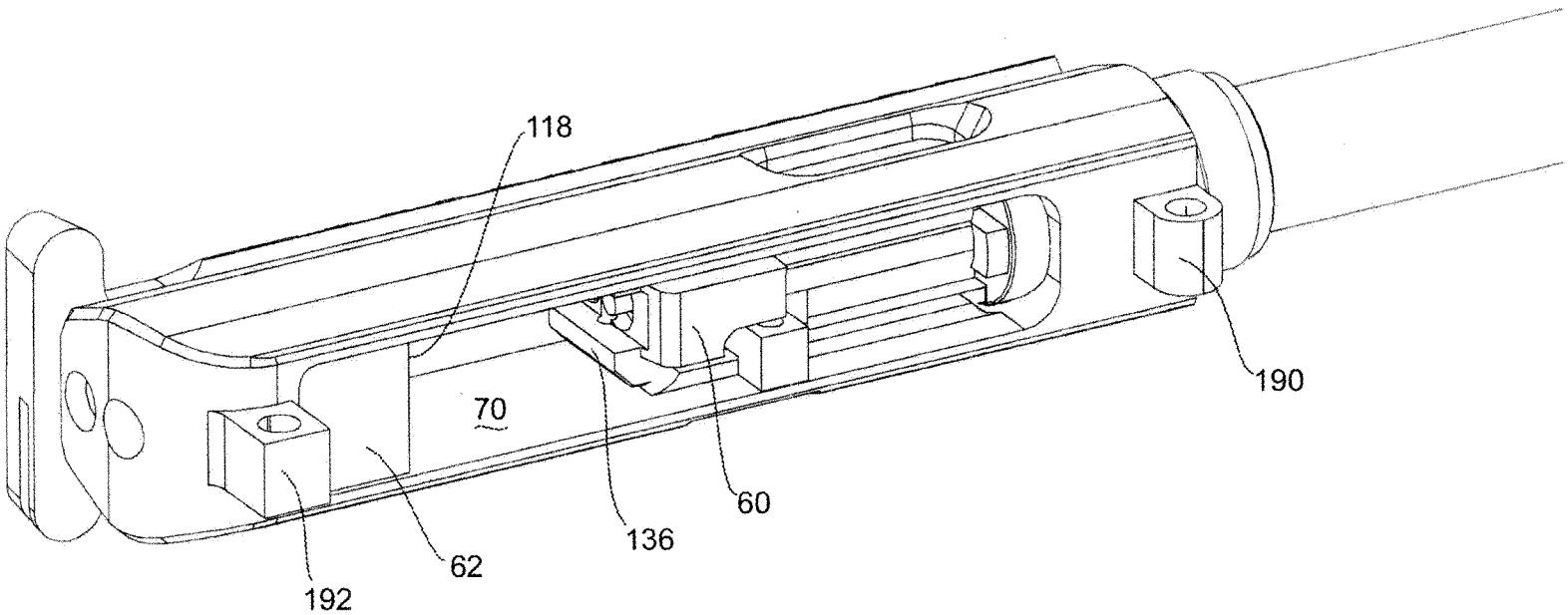
FIG. 8 shows the backer plate positioned within the interior chamber of the upper receiver.
Figure 9:
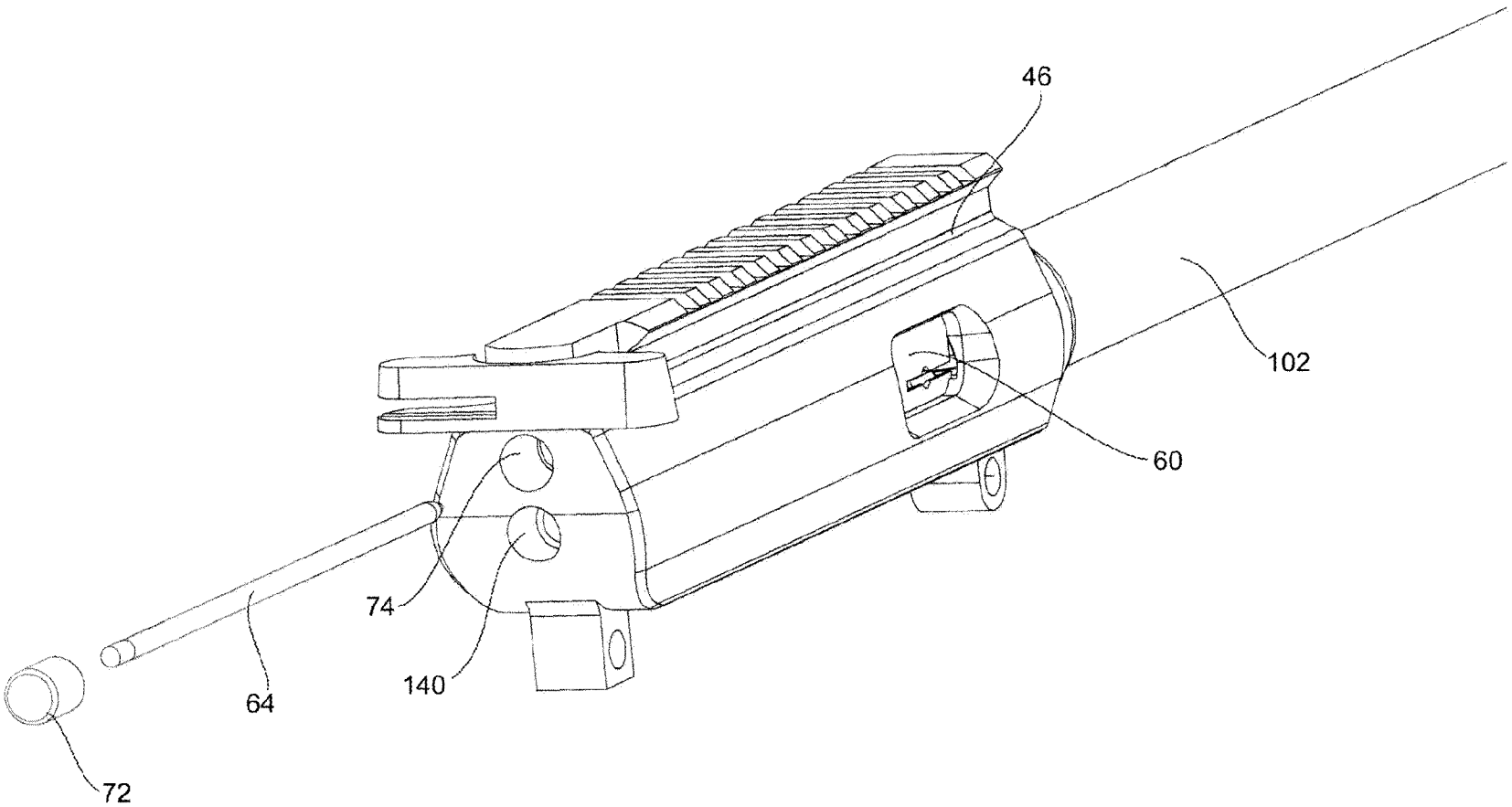
FIG. 9 shows a recoil spring guide about to be assembled to the upper receiver.
Figure 10:
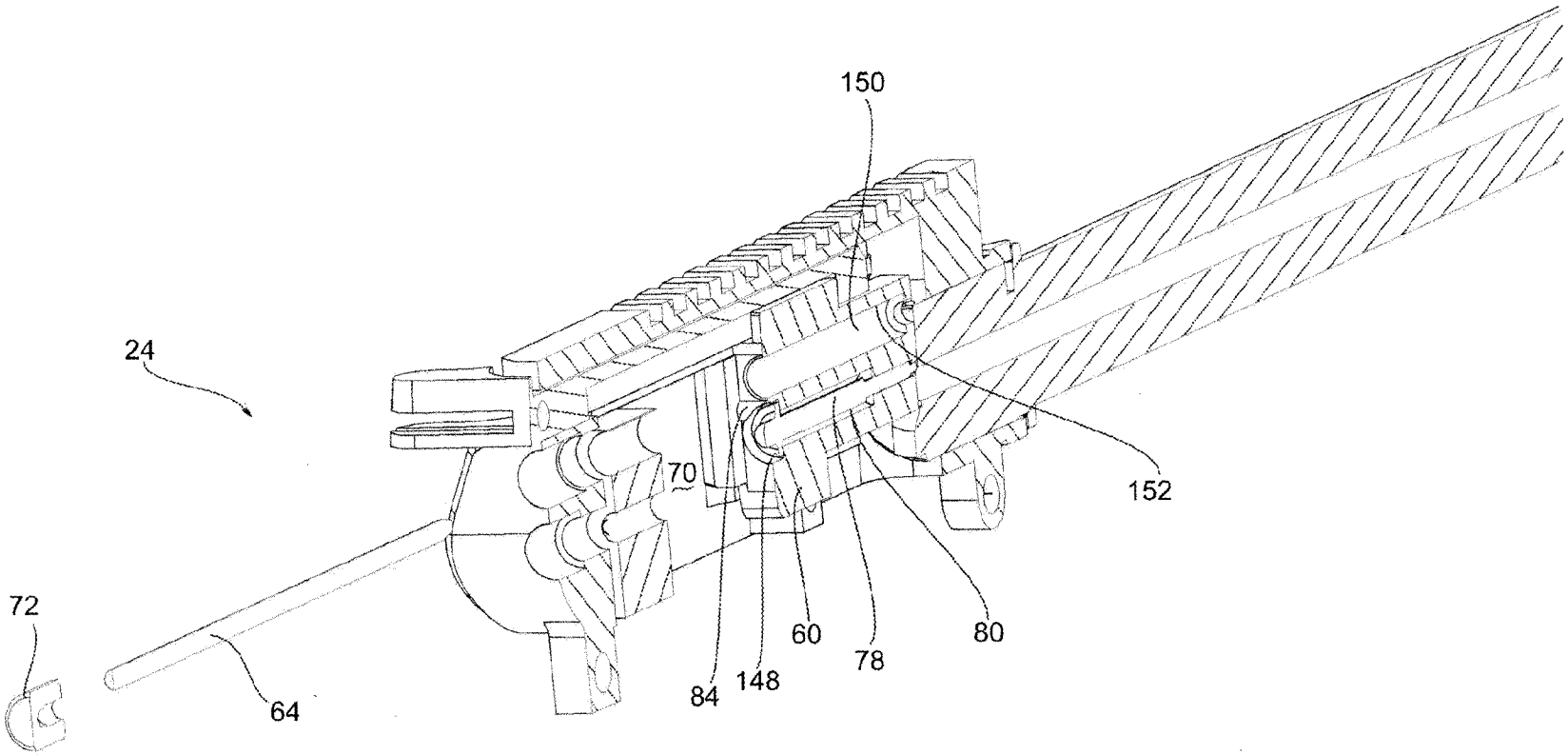
FIG. 10 shows a view similar to FIG. 9 except in a cross-sectional view to show the internal components in the upper receiver.

Referring back to FIG. 5, it can be appreciated that the bolt 60 is positioned below the interior chamber 70, and the recoil spring guide and the retaining plugs 64 and 72 are positioned longitudinally behind the upper receiver 46. In a first phase of assembly, the bolt 60 can be entered within the interior chamber 70. As shown in FIG. 6, it can be appreciated that the longitudinally rearward region 128 of the chamber 70 is of a sufficient cross-sectional area to allow the bolt to be fitted therein, as shown in FIG. 7, and then positioned forwardly where a bolt retaining member 130 shown in FIGS. 6 and 7 can be utilized to house the bolt therein and constrain the bolt to longitudinally rearward and forward motion. It should be noted that the charge handle 66 is shown mounted in the upper receiver, but this component too can be removed from the upper receiver 46. As further shown in FIG. 7, the backer plate 62 is also positioned below the interior chamber 70, and as shown in FIG. 8, the backer plate 62 can be housed in the longitudinal rearward portion of the interior chamber 70. Once the backer plate is in place (see also FIG. 4), it can be utilized to engage the longitudinal rearward surface 136 of the bolt 62 to prevent the bolt from repositioning too far rearwardly to fall out of the interior chamber, or become misaligned during operation of the action. Referring to FIG. 9, it can be appreciated that to further assemble and maintain the bolt 60 to be housed in the upper receiver 46, the recoil spring guide 64 can be mounted therein and pass through the surface defining the spring guide passage 74 of the upper receiver 46. Further, the retaining plug 72, otherwise referred to as the guide rod retaining screw, is operatively configured to be engaged and more specifically threadedly engaged to the surface defining a spring guide passage 74. Further, the back plate locking passage 140 is configured to have a member such as a threaded member 182 pass therethrough and engage the locking location (see FIG. 6) 142 of the backer plate 62. It should be noted that the backplate further has a recoil spring passage 144 to allow the recoil spring guide 64 to pass therethrough. As shown in FIG. 9, there would be a helical spring positioned around the recoil spring guide when being inserted through the surface defining a spring guide passage 74. FIG. 10 shows a cross-sectional view of the partially assembled upper assembly 24. It can be appreciated that the interior chamber 70 allows sufficient rearward travel of the bolt 60. Further, as best shown in FIG. 10, the firing pin passage 80 allows for longitudinal motion of the firing pin and the firing pin retaining surface 84, where a cross pin (82 of FIG. 3) is configured to engage the flange portion 148 of the firing pin 78. Further, the recoil spring chamber 150 can be seen where force can be imparted, for example, at the annular surface 152 of the bolt of a helical spring (not shown but configured to be positioned around the recoil spring guide 64).

As further shown in FIG. 8, it should be noted that the first lower receiver attachment location 190 is shown along with the second lower receiver attachment location 192. These attachment locations are designed to be similar in dimension to the attachment locations of an upper receiver of a conventional Ar-15 so as to be mounted to the lower receiver of an AR-15.

Figure 12:
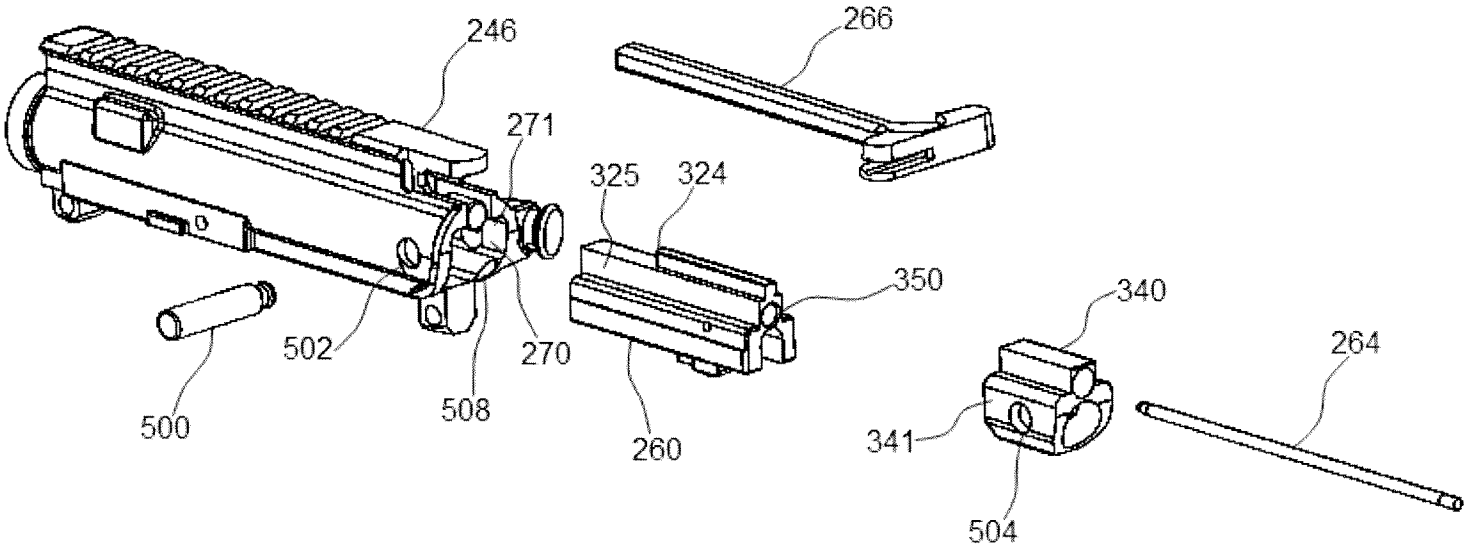
FIG. 12 is an exploded view of another embodiment of the disclosure.
Figure 13:
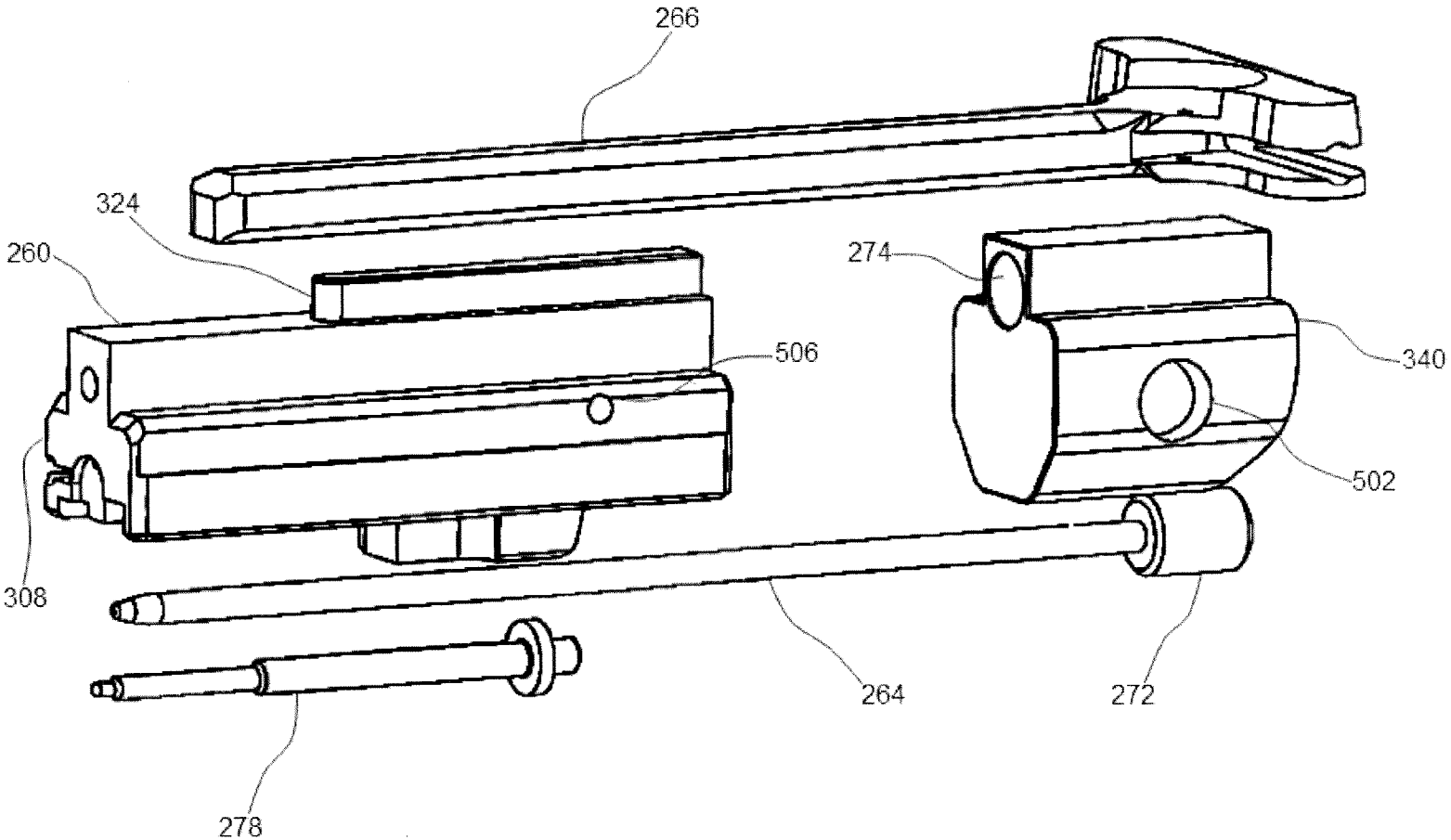
FIG. 13 is an exploded view of several components of the embodiment of FIG. 12.
Figure 14:
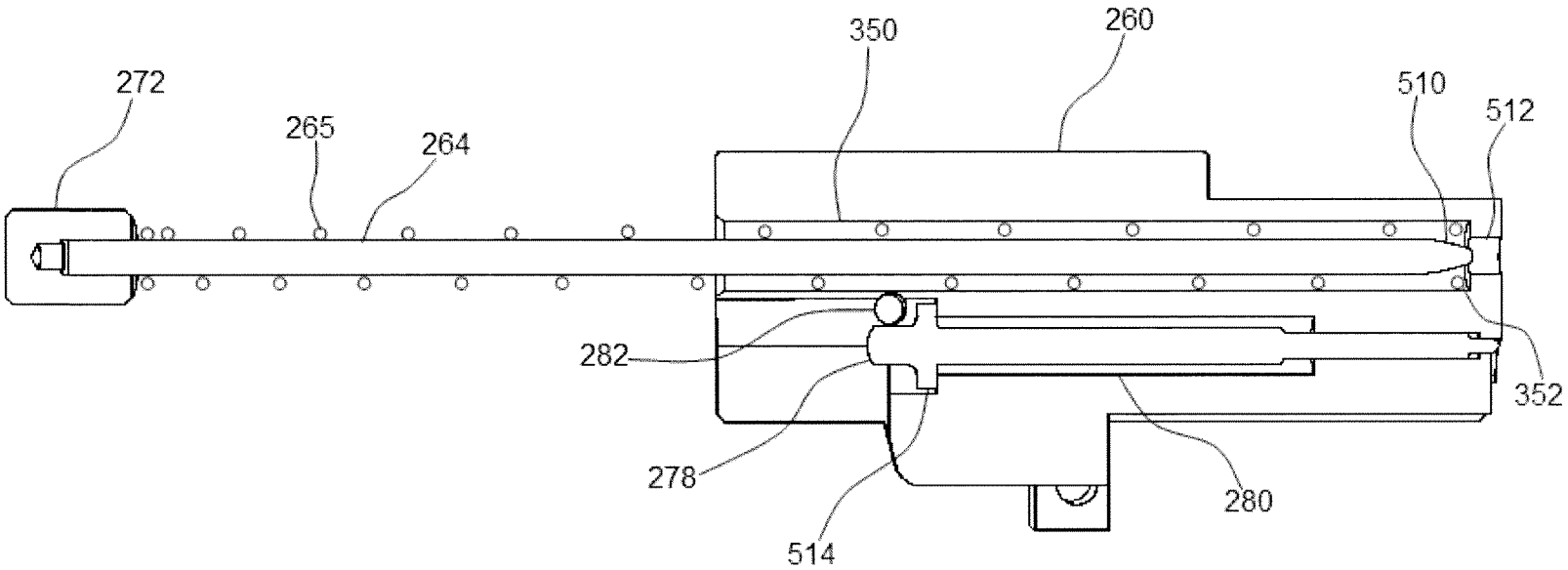
FIG. 14 is a cutaway view of several components of the embodiment of FIG. 12.

FIGS. 12-14 show another embodiment wherein all of the components can be removed from the modified upper receiver 246 through an enlarged rear opening 508. In this embodiment, components similar to previous embodiments are numbered similarly, but offset by 200. For example, the recoil spring guide of the previous embodiment is labeled 64, and in this embodiment is labeled 264. Similarly, the backplate in earlier embodiments is numbered 140, and in this embodiment the backplate is numbered 340.

Looking to FIG. 12, the upper receiver 246 shown is quite different from a standard receiver in that the interior chamber 270 is machined out to accept a novel bolt 260. The bolt 260 comprises a spring guide chamber 350, which allows the recoil spring guide 264 to pass therethrough. It can be seen how the outer surface 341 of backplate 340 slides into an engaging surface 271 of the interior chamber 270 of the upper receiver 246. This results in a sliding fit between the two components, such that the backplate 340 can easily be removed to gain access to the other components of the device. In one form, a crosspin 500 engages crosspin receivers 502 and 504 in the upper receiver 246 and backplate 340 respectively to fixedly hold the backplate 340 in place within the upper receiver 246.

The outer surface 325 of the bolt 260 also engages the inner surface 271 of the interior chamber 270 for longitudinal motion therewithin.

Looking to FIG. 14, the bolt 260 can be seen in cross-section, along with the recoil spring guide 64. The recoil spring 265 is shown extending from the retaining plug 72 to the annular surface 352 of the recoil spring chamber 350 to provide tensile forces therebetween. In one form, the forward portion of the recoil spring guide 264 comprises a tapered portion 510 to assist in alignment with a reduced diameter portion 512 of the recoil spring chamber 350.

In addition, one embodiment of the firing pin 278 is shown in cross section, including a flange 514, which engages a crosspin 282 to maintain position of the firing pin 278 within the firing pin passage 280. The crosspin 282 may be press fit or slide fit into the crosspin receiver 506 shown in FIG. 13.

In one form, the retaining plug 272 and recoil spring guide 264 are a monolithic structure, but they may be independent, connected structures. The bolt 260, firing pin 278, and upper receiver 246 may also be monolithic, or substantially monolithic.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore we claim:

1. A firearm upper receiver assembly comprising:

a. a modified upper receiver having an interior surface defining an interior chamber, a longitudinal forward region having a barrel mounting portion, a longitudinal rearward region comprising a surface defining a spring guide passage, an upper region having a surface defining a charge handle passage;

b. a bolt having a slide fit with the interior surface of the upper receiver, the bolt comprising a surface defining a firing pin—passageway, a rimfire firing pin movably positioned to move a prescribed amount of distance within the firing pin passageway, the bolt having a longitudinally forward region with a bolt surface, the bolt having an upper region having a charge handle engagement surface, the bolt further having a surface defining a recoil guide rod chamber;

c. a charge handle having a slide fit with the charge handle passage of the upper receiver, the charge handle having a bolt engagement feature positioned to engage the charge handle engagement surface of the bolt wherein the charge handle is configured to reposition the bolt in a longitudinal rearward direction with respect to the upper receiver and further the bolt can reposition longitudinally rearwardly and forwardly without movement of the charge handle when the charge handle is in a longitudinally forward orientation with respect to the upper receiver;

d. a recoil spring guide coupled to a longitudinal rearward portion of the upper receiver where the recoil spring guide rod passes through the surface defining a recoil guide rod chamber within the bolt;

e. a backer plate in slide fit engagement with the longitudinal rearward region of the interior chamber of the upper receiver and fastened thereto;

f. wherein the recoil spring guide is positionable relative to the backer plate;

g. a threaded retaining plug is threadedly attached to a threaded recess in the upper receiver, wherein the threaded recess is coaxial to the recoil spring guide, wherein the rearward end of the recoil spring guide is retained within the retaining plug; and h. wherein the recoil spring guide is removably coupled to the backer plate.

2. The upper receiver assembly as recited in claim 1, where the recoil guide rod chamber is positioned above the firing pin passage.

3. The upper receiver assembly as recited in claim 1, where the mass of the bolt is greater than 4 ounces.

4. The upper receiver assembly as recited in claim 1 further comprising a compression recoil spring within the recoil guide rod chamber and encircling the recoil guide rod.

5. The upper receiver assembly as recited in claim 1, where a guide rod retaining screw is operatively configured to engage the longitudinally rearward portion of the upper receiver to retain the recoil spring guide in the upper receiver.

6. The upper receiver assembly as recited in claim 1, where the backer plate has a surface defining a recoil spring passage defined therein.

7. The upper receiver assembly as recited in claim 6, where the backer plate has a locking location which corresponds in location to a backer plate locking passage located in the longitudinally rearward portion of the upper receiver.

8. A firearm upper receiver assembly comprising:

a. a modified upper receiver having an interior surface defining an interior chamber, a longitudinal forward region having a barrel mounting portion, a longitudinal rearward region comprising a surface defining a spring guide passage, and upper region having a surface defining a charge handle passage;

b. a bolt having a slide fit with the interior surface of the upper receiver, the bolt comprising a surface defining a firing pin passageway, a rimfire firing pin movably positioned to move a prescribed amount of distance within the firing pin passageway, the bolt having a longitudinally forward region with a bolt surface, the bolt having an upper region having a charge handle engagement surface, the bolt further having a surface defining a recoil guide rod chamber;

c. a charge handle having a slide fit with the charge handle passage of the upper receiver, the charge handle having a bolt engagement feature positioned to engage the charge handle engagement surface of the bolt wherein the charge handle is configured to reposition the bolt in a longitudinal rearward direction with respect to the upper receiver and further the bolt can reposition longitudinally rearwardly and forwardly without movement of the charge handle when the charge handle is in a longitudinally forward orientation with respect to the upper receiver;

d. a recoil spring guide coupled to a longitudinal rearward portion of the upper receiver where the recoil spring guide rod passes through the surface defining a recoil guide rod chamber within the bolt;

e. a backer plate in slide fit engagement with the longitudinal rearward region of the interior chamber of the upper receiver and fastened thereto;

f. wherein the recoil spring guide is removably coupled to the backer plate;

g. where the backer plate has a surface defining a recoil spring passage defined therein;

h. where the back plate has a locking location which corresponds in location to a backer plate locking passage located in the longitudinally rearward portion of the upper receiver; and i. where a threaded member is configured to pass through the backer plate locking passage of the upper receiver and threadedly engage the locking location of the backer plate.

9. An upper receiver assembly operatively configured to be attached to a lower receiver having first and second attachment locations, the upper receiver assembly comprising:

a. an upper receiver having longitudinal forward and rearward regions, the upper receiver having an interior surface defining an interior chamber;

b. a barrel removably attached to the longitudinally forward region of the upper receiver;

c. a bolt assembly of components comprising:

i. a bolt of a surface defining a firing pin passageway, the bolt further having a surface defining a recoil guard rod chamber, the bolt further having a charge handle engagement surface;

ii. a firing pin housed in the bolt and operatively configured to travel through the firing pin passage;

d. a charge handle configured to pass through a charge handle passage of the upper receiver, the charge handle having a bolt engagement feature operatively configured to apply to engage the charge handle engagement surface of the bolt;

e. a backer plate, the backer plate removably attached to the upper receiver positioned in a longitudinal rearward portion of the interior chamber, the backer plate having a surface defining a recoil spring guide passage;

f. where the backer plate has a locking location which corresponds in location to a backer plate locking passage located in the longitudinally rearward portion of the upper receiver;

g. where a threaded member is configured to pass through the backer plate locking passage of the upper receiver and threadedly engage the locking location of the backer plate; and h. a recoil spring guide passage configured to be inserted and attached to the upper receiver through a surface defining a spring guide passage in the upper receiver, the recoil spring guide configured to further pass through the recoil spring guide passage of the backer plate;

i. whereas the bolt is operatively configured to reposition in a longitudinal direction within the interior chamber of the upper receiver and the upper receiver having first and second lower receiver attachment locations positioned in a manner to engage and be attached to a lower receiver at the first and second attachment locations respectively thereof where the position of the firing pin in the bolt is at a prescribed location with respect to the lower receiver.

10. The upper receiver assembly as recited in claim 9, where the upper receiver is chambered to fire a .22 caliber round.

11. The upper receiver assembly as recited in 10, where the lower receiver is configured to operate with a centerfire high-caliber rifle round and the upper receiver retrofits to the lower receiver to shoot the .22 caliber round.

12. The upper receiver assembly as recited in claim 9, where the surface defining the recoil guide rod chamber is positioned vertically above the surface defining a firing pin passage.

* * * * *